US009638380B2

(12) United States Patent
Kramer et al.

(10) Patent No.: US 9,638,380 B2
(45) Date of Patent: May 2, 2017

(54) BENDABLE LED STRIP

(71) Applicants: Michael Kramer, Kamp-Lintfort (DE); Carsten Schaffarz, Rheinberg (DE)

(72) Inventors: Michael Kramer, Kamp-Lintfort (DE); Carsten Schaffarz, Rheinberg (DE)

(73) Assignee: LED-LINEAR GMBH, Neukirchen-Vluyn (DE)

( * ) Notice: Subject to any disclaimer, the term of this patent is extended or adjusted under 35 U.S.C. 154(b) by 0 days.

(21) Appl. No.: 14/226,877

(22) Filed: Mar. 27, 2014

(65) Prior Publication Data

US 2017/0030536 A1 Feb. 2, 2017

(30) Foreign Application Priority Data

Mar. 27, 2013 (DE) ..... 10 2013 005 230

(51) Int. Cl.

| | |
|---|---|
| ***F21S 4/22*** | (2016.01) |
| ***F21V 23/06*** | (2006.01) |
| ***H01R 4/24*** | (2006.01) |
| ***H01R 13/52*** | (2006.01) |
| *F21Y 115/10* | (2016.01) |

(52) U.S. Cl.

CPC ..... *F21S 4/22* (2016.01); *F21V 23/06* (2013.01); *H01R 4/2404* (2013.01); *H01R 13/5205* (2013.01); *F21Y 2115/10* (2016.08)

(58) Field of Classification Search

CPC ..... F21S 4/22; F21V 23/06; H01R 13/5205; H01R 4/2404

See application file for complete search history.

(56) References Cited

U.S. PATENT DOCUMENTS

| | | | |
|---|---|---|---|
| 5,848,837 | A | 12/1998 | Gustafson |
| 6,113,248 | A | 9/2000 | Mistopoulos et al. |
| 6,866,394 | B1 | 3/2005 | Hutchins |
| 7,160,140 | B1 | 1/2007 | Mrakovich et al. |
| 2002/0110000 | A1 | 8/2002 | Marcus |
| 2005/0231943 | A1 | 10/2005 | Sloan et al. |

(Continued)

FOREIGN PATENT DOCUMENTS

| | | | |
|---|---|---|---|
| DE | 102008004238 | A1 | 7/2009 |
| DE | 202009013278 | U | 10/2010 |
| WO | 2012062191 | A1 | 5/2012 |

*Primary Examiner* — David V Bruce

(74) *Attorney, Agent, or Firm* — Andrew Wilford

(57) ABSTRACT

The invention relates to a flexible LED strip, comprising modules that include light-emitting diodes (3) arranged successively at intervals, in particular equal intervals longitudinally, wherein the light-emitting diodes (3) of each module are electrically interconnected on one circuit board (2) each, in particular together with other electronic modules (4), and the LED strip can be severed between the modules, in particular without destroying the electrical functionality of the modules, wherein each module has at least one contact region at which a power supply can be connected to the module and all circuit-board sections (2) are mounted in a flexible enclosure (1), wherein the at least one contact region of each module extends through the enclosure (1) and can be electrically contacted outside the enclosure (1). The invention furthermore relates to an end piece (7), a coupling piece (8), and a connector piece for power-supply lines (6) or control-signal lines (6) of this LED strip.

21 Claims, 7 Drawing Sheets

(56) References Cited

U.S. PATENT DOCUMENTS

| | | | | |
|---|---|---|---|---|
| 2007/0087619 | A1 | 4/2007 | Nall et al. | |
| 2007/0279338 | A1 | 12/2007 | Varrin et al. | |
| 2008/0030981 | A1 | 2/2008 | Mrakovich et al. | |
| 2010/0149811 | A1 | 6/2010 | Sloan et al. | |
| 2011/0075413 | A1 | 3/2011 | Smith et al. | |
| 2012/0063139 | A1 | 3/2012 | Benkart et al. | |
| 2012/0276758 | A1* | 11/2012 | Donauer ..... | F21V 19/003<br>439/59 |

* cited by examiner

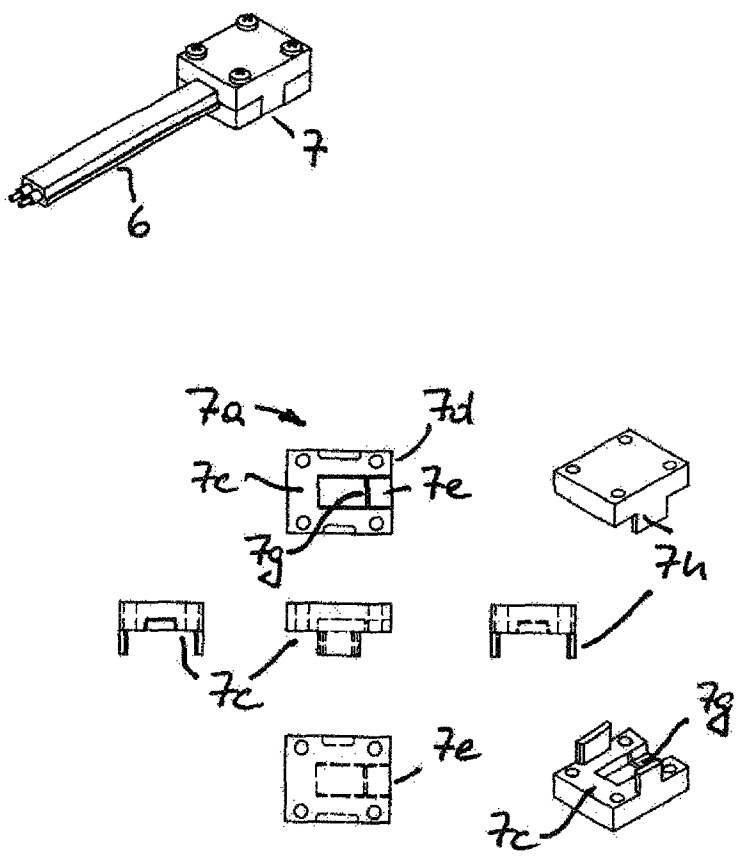
Fig. 5
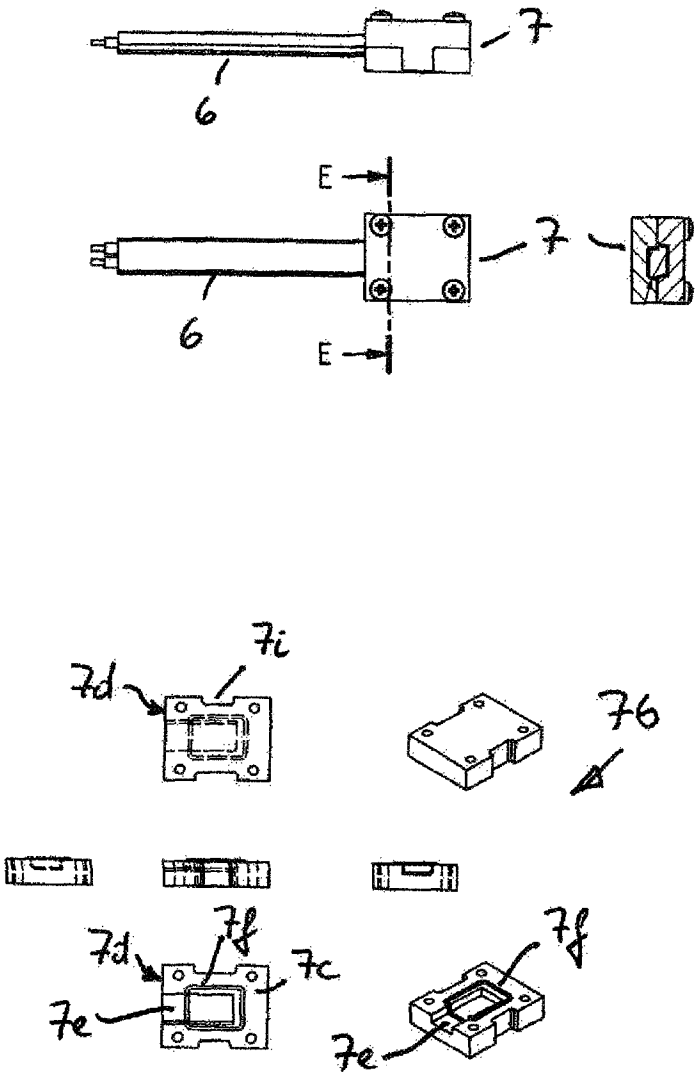

BENDABLE LED STRIP

The invention relates to a flexible LED strip, comprising modules that include light-emitting diodes arranged successively at intervals, in particular equal intervals longitudinally, wherein the light-emitting diodes of each module are electrically interconnected on one circuit board each, in particular together with other electronic components, and the LED strip can be severed between modules, in particular without destroying the electrical functionality of the modules, wherein each module has at least one contact region at which a power supply can be connected to the module and all circuit-board sections are mounted in a flexible enclosure.

The term modules including light-emitting diodes is understood to refer to modules that include at least one light-emitting diode.

Flexible LED strips are well known in the prior art and are typically created by using a flexible circuit board, for example a polyimide-based flexible circuit board, for the purpose of interconnecting the light-emitting diodes on this LED strip.

The approach is well known in the art whereby a predetermined number of light-emitting diodes along with electronic components such as, for example constant-current sources to operate these light-emitting diodes, are functionally combined to create a module on circuit-board sections of this flexible circuit board, provision being made whereby conductive traces are routed between the modules arranged successively in the longitudinal direction of this LED strip from one module to the immediate next module, thereby ensuring that power is supplied to all of the modules on this flexible circuit board. Provision can be typically made here whereby without degrading the functionality of each module an LED strip can be severed in a region between the modules, the strip including only the power-supply lines that are routed between modules.

This then provides the essential capability whereby flexible LED strips of the known type can be produced in long lengths, optionally in an endless continuous fashion, enabling them to be tailored to the desired length based on customer specifications.

An approach is furthermore well known in the art where these LED strips are provided without any encapsulation of the circuit board and of the components located thereon, also where these LED strips are provided that include an encapsulation, for example by surrounding the flexible circuit board together with electronic components located thereon with potting, with the result that for example a desired IP protection class can be achieved, and these LED strips can thus also be offered with a splash-proof or waterproof seal. If encapsulation is used, provision is therefore made whenever when the LED strip is severed that both the enclosure as well as the circuit board mounted therein can be severed.

Due to the flexibility of the flexible circuit boards that are employed in the known fashion and due to enclosure-forming flexible potting, the LED strips of this constructive design can essentially be flexed in one direction, specifically, about one axis parallel to the surface of the flexible circuit board and transversely of the circuit board. Another well-known procedure, for example is thus to wind up LED strips of this type in a coil. This flexibility also yields applications in which the goal is to implement geometries for a lighting situation where these geometries deviate from a straight longitudinally extending line.

LED strips as defined by the invention are generally understood to include those designs in which the longitudinal length is much greater than the width, in particular also than the height, in particular where the length is at least 10 times greater than the width. LED strips as defined by the invention are understood to include light sources based on light-emitting diodes, and thus not only individual light-emitting diodes but also, for example so-called chip LEDs.

One aspect viewed as problematic with these prior-art LED strips is that flexibility is essentially enabled only in one axis as described above. The possibility of flexure is excluded in particular within the plane of the circuit board since this would produce a folding configuration in the flexible circuit board, and this negatively affects the components and conductive traces mounted on the circuit board and can thus produce cracks in current-conducting components and malfunctions.

In particular the fact that power-supply lines in the known flexible LED strips are routed continuously between the individual modules on the flexible circuit board means that their conductive traces for supplying power on the flexible circuit board must have large cross-sections since the electrical current required for all of the modules must be manageable within this conductive trace cross-section. Having such appropriately sized conductor cross-sections, however, also reduces the flexibility of this type of circuit board.

The object of the invention is therefore to develop a flexible LED strip of the generic type so as to also create expanded flexibility in addition to severability between the individual light-emitting diodes that are combined into modules, in particular a flexibility in a plurality of planes, and preferably also within a plane that is oriented parallel to the circuit board surface.

This object is achieved according to the invention by an approach wherein the at least one contact region of each module that is provided to link a module with a power supply is routed through the enclosure and can be electrically contacted outside the enclosure, in particular so that the power-supply lines can be routed outside the enclosure.

The essential core idea of the invention is based on an approach wherein the power-supply lines provided to power the individual modules are no longer implemented, as in the prior art, inside the enclosure or on the circuit-board sections that comprise the modules, but instead are moved out of the enclosure, and an electrical connection is subsequently effected between the power-supply lines and each module, the connection passing through the enclosure, in particular at the site of each module.

There is thus no longer any need according to the invention to provide conductive traces for the power supply with appropriately sized cross-sections inside the circuit-board sections or inside an enclosure of a flexible LED strip, with the result that simply eliminating these power-supply lines enhances flexibility.

The invention instead provides an approach whereby the power supply for each individual module inside this type of flexible LED strip is actually outside the enclosure, which implementation is enabled by the fact that the contact region associated within each module is routed through the enclosure, thereby providing the individual contactability of each module. This also provides the capability of supplying current to different modules within one and the same LED strip at different levels, for example or even supplying no current to them, whereas in the prior art all modules of an LED strip were supplied current at identical levels since all were connected to the same type of power supply through the internal power-supply lines.

Provision can be made whereby routing the respective contact regions of each module is preferably always effected on the same side of the enclosure of a flexible LED strip, thereby creating a connection side on one side of this flexible LED strip, from which side each respective connection of the individual modules to this power supply can be effected, for example through power-supply lines that run longitudinally of the flexible LED strip.

In a preferred embodiment, provision can be made here that the at least one contact region a contact element can be attached to each contact region or to the circuit-board section of the module including this region, which element extends from the circuit-board section completely through the enclosure to the outside, in particular perpendicular to the surface of this section. This implementation of the invention makes it possible to electrically route the contact region of each module through the enclosure by different approaches for variously implemented LED strips, that is, using different contact elements in order thereby to contact the LED strips according to the invention, for example even with power-supply lines of various implementations. The term contact region of a module is understood to refer to that region at which an electrical contact is established in order to supply current to a module. This contact region can be implemented, for example by soldering points of uninsulated conductive trace segments.

For example provision can be made whereby a contact element comprises at least two pins (such as, for example pin connectors) onto which a mating element comprising at least two socket-like elements can be push-fitted. These at least two pins enable connections to be created to the two required poles of a power supply voltage, with the result that this voltage can then also be supplied through a mating element comprising at least two sockets.

For example provision can thus be made whereby a power-supply or also a control-signal line, which extend longitudinally and comprise at least two wires spaced apart in the contact elements routed through the enclosure, include appropriate corresponding mating elements that can be plugged into the contact elements of the individual modules.

Provision can furthermore be made whereby an insulation cable jacket of a power-supply line with at least two conductors for the different polarities, or a control-signal line, can be pierced directly by the pins. In this case, a power-supply or a control-signal line is preferably used in which each wire is composed of a plurality of strands, with the result that a pin-like, preferably pointed element of the contact element of a module, which contact element is routed through the enclosure, is pushed through between the individual strands of each wire after piercing the cable jacket, thereby creating an electrical contact. This type of contact element is also identified as a stab contact.

In another embodiment, provision can for example be made whereby a contact element is provided as an element that comprises at least two stab contacts (at least one for each pole), thereby allowing an at least two-wire power supply cable with its respective wires to be pushed into this element, cutting through the insulation of the power-supply line or the control-signal line and contacting their internal conductors.

This last embodiment in particular has the advantage that a simple cable having at least two wires can be used to supply the power or transmit signals without requiring this cable to have mating elements to contact the contact element that has been inserted through the enclosure of the LED strip according to the invention. This substantially simplifies and enhances the embodiment according to the invention since standard pre-assembled cable cross-sections and geometries can be utilized.

A preferred embodiment can be provided whereby a contact element, in particular each contact element, in particular a contact element having at least two pins, has an open groove that runs longitudinally of the LED strip, in which groove a power-supply line and/or a control-signal line can be inserted, the electrical contacts being mounted in the groove, in particular the pins projecting transversely from the groove. This allows the power-supply line to be routed centrally through the groove, and during piercing ensures in particular that the conductors located in the line are engaged.

A development provides an approach whereby a mating element can be attached to a contact element, in particular can be push-fitted onto it, in particular such that a power-supply line and/or control-signal line that is inserted in the groove is completely surrounded by the contact element and mating element all around the line. This ensures, for example that a connected line is relieved from strain, in particular when installed.

The walls of the groove of the contact element can be snap-in flanges that interact with undercut areas in the groove walls of a groove in the mating element so as to lock in place, or alternatively, the walls of the groove in the mating element can be snap-in flanges that fit with undercut areas in the groove of the contact element so as to lock in place. This approach creates a simple fast and secure connection between the contact element and the mating element.

In order to achieve a seal, for example against moisture or contamination, provision can furthermore be made whereby the electrical contacts of the contact element, in particular the pins at the groove floor of the contact element, are annularly surrounded by a seal, in particular that seals off from the environment a region of an insulating jacket of the power-supply line and/or control-signal line that is to be pierced when such a wire is inserted.

In a preferred embodiment of the LED strip according to the invention, provision can be made whereby each circuit-board section on which a module is mounted has a separate circuit board and/or is implemented as a separate circuit board. This separate circuit board can, for example be a rigid circuit board. Provision is thus made in this embodiment whereby a plurality of individual, that is, separate circuit boards are mounted in succession inside an LED strip according to the invention, where in each case the longitudinal extent of these elements coincides with the longitudinal extent for the entire LED strip, in particular such that the circuit boards each have a gap relative to each other so that no electrical connection at all is established, in particular also no mechanical connection created by the circuit board material is established between the individual circuit boards and therefore the circuit-board sections comprising the module. Provision is made whereby an LED strip can be severed in this gap between two circuit boards. Since an enclosure, in particular that is thus accordingly implemented to be flexible ensures free movability of the individual circuit boards or circuit-board sections relative to each other, what is also created by an LED strip according to the invention of this constructive design is a flexibility in a plurality of dimensions or planes, such as, for example including being able to be twisted about the longitudinal axis.

It is obvious that this embodiment also has the possibility of using flexible individual circuit boards, that is, circuit boards that are not joined by circuit board material, instead of rigid separate individual circuit boards.

In this embodiment comprising separate circuit boards, provision can be made for example whereby a contact region of a circuit board that is accordingly implemented separately is mounted centrally relative to the length of this separate circuit board. This type of central arrangement can also be provided in terms of the length of a circuit-board section in the embodiment that is described below.

Another embodiment of the LED strip according to the invention provides an approach whereby each circuit-board section on which a module is mounted is a sub-section of a circuit board, in particular a single flexible circuit board of the entire LED strip on which a plurality of the modules are mounted. Although this design in terms of principle matches the same construction as known in the prior art, it here comprises the added implementation that no elements that electrically connect the respective circuit-board sections, in particular no conductive traces, are provided on the shared flexible circuit board between the individual circuit-board sections. What therefore exists between two adjacent circuit-board sections is only regions on a flexible circuit board that are formed exclusively of circuit board base material but do not comprise any conductive elements, in particular no conductive traces.

A flexible circuit board comprising a plurality of these successively arranged circuit-board sections that are connected to each other mechanically by circuit board material (for example polyimide) at clear circuit board regions, therefore has an enhanced flexibility as compared with the prior art since here too no power-supply lines with large conductive cross-sections for transferring current or voltage from module to module are present on the circuit board.

This embodiment also has flexibility within the plane of the circuit board since any folding of the flexible circuit board material is easily possible as compared with the prior art and is not restricted by the large cross-sections for the power-supply lines.

Circuit board regions in particular at which the circuit-board sections are connected without any conductive traces can be readily crimped and folded since such bending strain does not affect any electrical or electronic conductive elements. These empty circuit board regions between the circuit-board sections comprising the modules are provided so as to enable severing the LED strip here. It is impossible for any corrosion to occur after severing at these points since clear circuit-board sections do not have any metal conductors.

According to the invention, provision can be made in order to create an enclosure whereby both the separate circuit boards that each include one or optionally a plurality of modules, and also a shared flexible circuit board with its respective modules mounted in sub-sections thereon are surrounded by an elastic transparent potting in order thereby to also create for example a waterproof seal or protection against splashed water. Provision can be made here whereby each of the contact regions or the contact elements of each module mounted thereon are routed to the outside through this potting, thereby allowing them to be contacted from outside the potting.

Another embodiment provides an approach whereby the enclosure is formed by a hollow profile that is open in direction in which light is emitted, which profile is flexible, for example is produced from an elastomer material. This can, for example involve a U-shaped profile on whose floor the modules are mounted and that has holes in its floor through which the respective contact elements attached to the contact regions of the modules are routed from the interior of the hollow profile to the outside, the interior of the hollow profile being completely filled with a transparent potting.

Thus provision can be made in one procedural step for producing this LED strip according to the invention whereby a flexible hollow profile that is open in the direction light is emitted is first provided as a prefabricated molded part and has the appropriate holes in its floor allowing the contact elements to pass through, or is itself pierced by the contact elements, for example pin-like contact elements.

These holes or piercing sites can be mounted, for example equidistantly, thereby matching the equidistance of the contact elements on the modules whenever all of these are mounted on a single flexible circuit board, or also thereby defining the gap intervals at which individual circuit boards can be plugged into the hollow profile during production.

One possible embodiment thus also provides the capability of producing a plurality of individual separate circuit boards, such as, for example rigid circuit boards that each independently include at least one module composed of a plurality of LEDs, optionally also including additional electronic components such as constant-current sources, with the result that each individual separate circuit board is functionally independently and creates a corresponding functional unit. These individual separate circuit boards can then be inserted at the interval spacing of the holes or piercing sites into a corresponding open flexible hollow profile so that the contact elements that are each preferably mounted on the bottom of a circuit board project out of the hollow profile through the holes or the piercing sites in the floor.

After insertion of the one flexible circuit board or a plurality of separate circuit boards in the flexible hollow profile, it is thus possible to effect potting, that is completely filling the interior region of the hollow profile with a transparent potting, regardless of whether individual rigid or flexible circuit boards are used, or, on the other hand, a shared flexible circuit board is used on which the corresponding modules are mounted in successively arranged circuit-board sections of these flexible circuit boards at certain intervals.

Provision can be made in the two different implementations of possible circuit boards whereby either the lower face of the circuit board (elements or sections) can touch the floor of the hollow profile, or also, on the other hand, whereby the lower faces of the circuit boards are each spaced transversely from the floor of the hollow profile, which approach yields the further advantage that the potting injected into the hollow profile is applied to each circuit board not only at the top, but also gets in between the circuit board and floor of the hollow profile, thereby effecting a complete hermetic waterproof seal. Any gaps remaining between the contact element and the holes in the floor of the hollow profile are thus automatically closed by the potting.

A preferred embodiment, which can be combined with the previous embodiments, provides an approach whereby the light-emitting diodes are mounted on an upper face of a shared flexible circuit board or on each separate circuit board, each contact element associated with a module being mounted on the respective lower face. The advantage of this configuration is that a contact element can always be passed through the floor of the above-referenced hollow profile, while the light emission direction for each light-emitting diode is the direction of the open region of the hollow profile.

When rigid circuit boards, in particular are used to receive each module, this requires that this type of circuit board can be fitted with components on both sides—in particular whereby accordingly a component insertion machine that is appropriately implemented on both sides must be used.

Another possible variant embodiment can be provided here whereby, in terms of the respective modules, flexible circuit boards, each of separate type are used, or, on the other hand, a shared flexible circuit board for all modules is used that is fitted according to the invention only on one side both with light-emitting diodes and any electronically required components, as well as with contact elements. The invention provides an approach here whereby this flexible circuit board is divided in half longitudinally such that an imaginary dividing line runs longitudinally, and the light-emitting diodes are mounted on the one half and the contact elements are mounted on the other half. Provision can furthermore be made whereby any additional electronic components required for operation, such as for example constant-current sources, are also mounted in the half in which the light-emitting diodes are located.

Provision can thus be made whereby the flexible circuit board is folded over by 180° along its longitudinal extent, that is, about a fold line longitudinally and preferably centrally relative to the width (transversely), thereby enabling an arrangement of light-emitting diodes to be achieved on an upper face and an arrangement of contact elements to be achieved on a lower face relative to the folded circuit board. An arrangement of these circuit boards in a hollow profile of the above-described constructive form can also be created in which the contact elements are passed through corresponding holes in the floor of the hollow profile or pierce this floor, and the diodes have their corresponding orientation toward the open side of the hollow profile. This approach according to the invention allows an exclusive single-side component placement of the flexible circuit boards to be provided on component insertion machines that operates accordingly only on one side.

After the circuit boards have been potted or the hollow profile has been completely filled with a transparent potting, the separation points may no longer be visible externally at which severing the finished LED strip is possible without damage while maintaining the functionality of the individual modules, and for this reason a development according to the invention provides an approach whereby a plurality of markings are mounted on the enclosure, in particular a plurality of equidistant markings, that show the location of the point at which the LED strip can be divided without destroying the functionality of the modules.

In the one embodiment comprising separate circuit boards, this type of marking identifies that region (separation point) in the enclosure of a LED strip according to the invention that corresponds to the gap between two adjacent separate circuit boards in which no circuit board material is present, with the result that only the flexible material of the enclosure and the potting accommodated therein can be severed at this point by a knife or scissors.

In the embodiment in which all of the modules are mounted on a shared flexible circuit board in which, however, this flexible circuit board does not include any electrically conductive or connecting elements, in particular any conductive traces, this marking accordingly identifies this corresponding circuit board region (separation point) that can be severed without destroying electrical functionality.

The ends of this LED strip according to the invention that are separated in these embodiments continue to be hermetically sealed in the one embodiment comprising the internally provided separate circuit boards since the end face is composed only of potting and no electrical or electronic component projects into this end face.

Only in the embodiment comprising a shared flexible circuit board does the severed flexible circuit board terminate at the end face—however, not with any electrical lines, while at the same time this flexible circuit board is preferably completely surrounded by potting so that here too a corresponding waterproof seal is maintained.

Regardless of whether an LED strip according to the invention has separate circuit boards or a continuous, preferably flexible circuit board, provision can be preferably made whereby the LEDs are mounted equidistantly inside the modules, also across a plurality of modules and thus possibly across a plurality of circuit boards.

The spacing of an end LED of an LED strip from the end of the strip can be selected so that the same distance between end LEDs of both strips exists across strips for adjoining ends of two separate LED strips according to the invention as also exists between the LEDs of one of the strips. This enables LED strips to be joined without this being discernible in terms of the light emission pattern.

Additional end components, coupling components, or connector components that function together with the LED strip according to the invention or its lines can be provided in order to terminate or contact the power-supply lines or control-signal lines for these LEDs at the end, or to interconnect them in current-conducting fashion, or to couple in signals or current to this line or couple them out from this line at any site other than the end.

An end piece can thus be provided for a power-supply line or control-signal line of an LED strip, which end piece has a top part and a bottom enclosure section, both of which can be connected to each other at respective connecting faces, and at least one of the parts, preferably both such parts, has/have in the connecting face a groove that terminates in a lateral face of the part and is open toward the other part, into which groove one end of a power-supply line and/or control-signal line can be inserted. Inserting a line and connecting the parts thus enables a mechanical and/or electrical termination to be created at the end of a line.

Provision can preferably be made here whereby at least one of the parts has an annular seal, one sub-region of which is located in the connecting face and the other sub-region of which is located in the groove floor and walls, and in frame-like fashion surrounds the end of the groove. The other part can furthermore include a seal that is located only in the groove wall and in the groove floor, in particular at a location of the groove that corresponds to that location of the groove of the other part at which the annular seal is located in the groove wall and floor. Whenever the end of a wire is inserted into the parts and interconnects these parts, the end of the wire is simultaneously surrounded completely by these seals and encapsulated from the environment.

An end piece of this type can also be used in order at the end of a line to couple in electrical signals or current to supply an LED strip to a line, or to couple the signals or current out from the line. To this end, an end piece can be developed in such a way that one of the parts has electrical contacts mounted in the groove, in particular pins projecting transversely from the groove floor, in order to establish electrical contact with a power-supply line and/or control-signal line, the electrical contacts being connected by a cable, or its plug connector, that is attached to this part.

Another possible approach is to couple signals or current in or out not only at the end of a line but at any desired location between the ends, that is, essentially in-line.

To this end, the invention provides a connector piece for power-supply lines or control-signal lines, which connector has a top part and a bottom part that can both be connected to each other at their connecting faces facing each other, and at least one of the parts, preferably both, include/s a continuous groove in the connecting face, which groove terminates in two mutually opposing lateral faces of the part and is open toward the other part, wherein a power-supply line and/or control-signal line can be inserted in the groove and thus passed through the connector piece, and at least two contacts, in particular two pins projecting transversely from the groove floor are mounted in the groove in order to establish electrical contact with an inserted power-supply line and/or control-signal line, the electrical contacts being electrically connected to a connector cable attached to the connector piece, in particular the plug connector of the connector cable.

The connector piece can thus be attached to this line at any location along the longitudinal extent of a line, and current or signals can be fed in or tapped through its cable or plug connector.

In terms of this connector piece, the electrical contacts, in particular the pins in the groove floor of the contact element can be annularly surrounded by a seal, in particular which element seals off from the environment a region to be pierced of an insulating jacket of the power-supply line and/or control-signal line.

In order to connect two lines, the invention preferably provides an approach whereby a connector piece is provided that has a top part and a bottom part that can be connected to each other at their mutually facing connecting faces, and at least one of the parts, preferably both, include/s in the connecting face two grooves that extend longitudinally and are preferably separate and each terminate in one of two mutually opposing lateral faces of the part and are open toward the other part, wherein one end of one of two power-supply lines and/or control-signal lines can be inserted in each of the grooves, and at least two contacts, in particular at least two pins projecting transversely into the groove floor are mounted in the groove floor of each of the grooves in order to establish electrical contact between one of the two power-supply lines and/or control-signal lines, the contacts of both grooves being electrically connected in pairs.

This enables current or electrical control signals to be transferred between the ends of separate lines.

Here too, at least one of the parts can include an annular seal, one region of which is located in the connecting face and the other region of which is located in the groove floor and walls of both grooves, and annularly surrounds the end of both grooves. The other part can include a seal in each groove that is located only in the groove wall and in the groove floor, in particular at a respective location of the groove that corresponds to the location of the groove of the other part at which the annular seal is located in the groove wall and floor.

Embodiments of the invention are shown in the following figures. Here:

FIG. 1 provides a plurality of views of an embodiment having separate circuit boards.

FIG. 5 shows an end piece to be attached to end of a line for the power supply or signal delivery to an LED strip.

Figure 1:
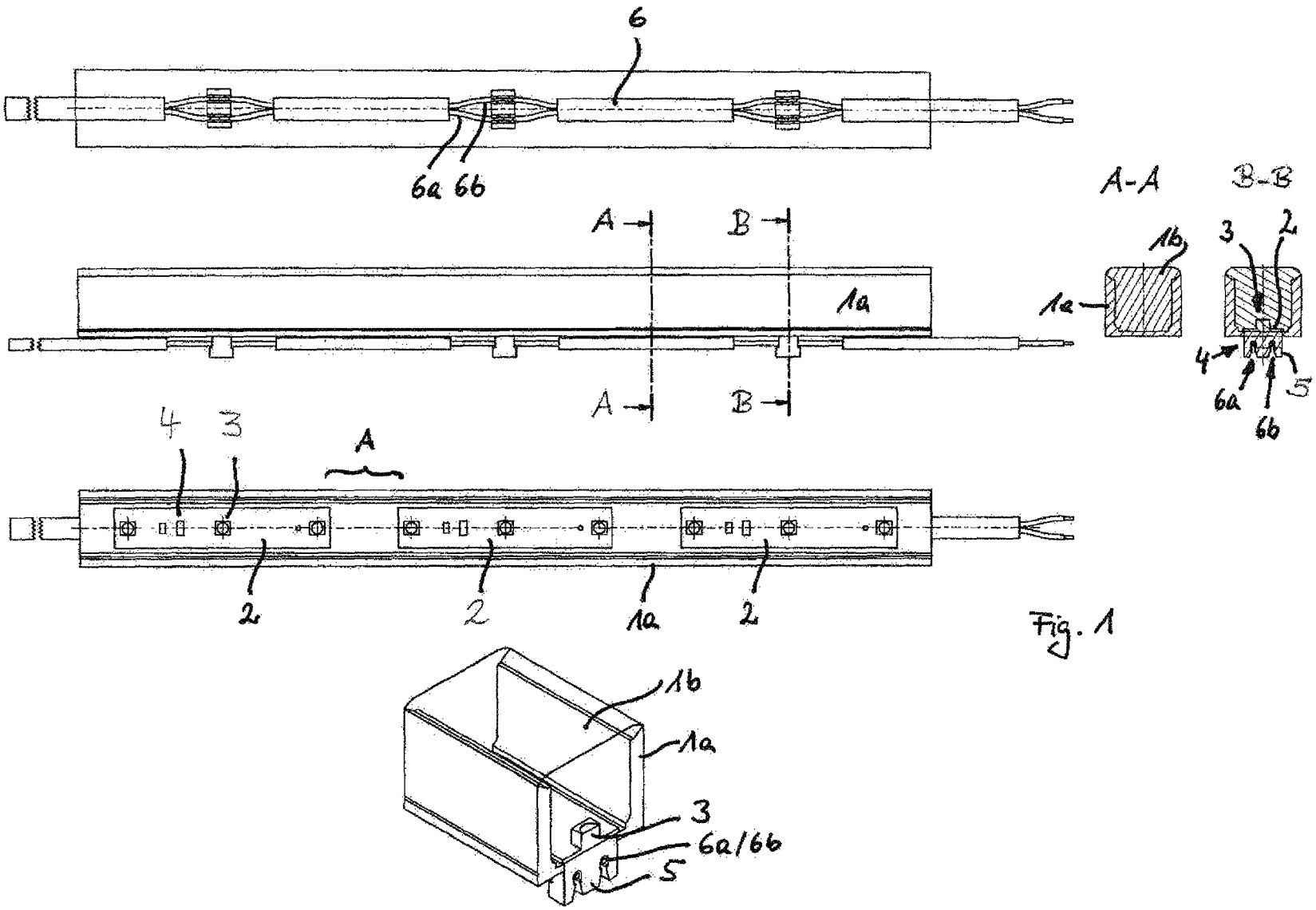

In FIG. 1 a plurality of views of a first preferred embodiment show an LED strip according to the invention comprising an enclosure 1 that is composed here of a unilaterally open hollow profile 1*a* that is essentially U-shaped and whose interior holds a plurality of circuit boards 2 each forming a section as defined by the invention on which a functionally interactive module is mounted that is composed of a plurality of electronic elements. These elements forming the module are in this case, for example light-emitting diodes 3, as well as additional electronic components 4, such as for example constant-current sources.

The cross-section perpendicular to the longitudinal extent of the LED strip according to the invention reveals that the electronic components, in particular the light-emitting diode 3 mounted on the upper face of each of the circuit boards 2, and, on the lower face of each circuit board 2, the contact region 4 to each of which a respective contact element 5 is attached. In this case, each contact element 5 is designed so as to include two stab contacts that are each electrically connected to the respective contact region of the module through the enclosure, and here also poke through the floor of the hollow profile 1*a*. A power supply cable 6 with its two wires 6*an* and 6*b* can be pushed onto the stab contacts of the contact element 5 such that the stab contacts cut through the insulation of the wires and come into contact with the inner metal conductors.

This ensures that each individual module, which are provided here as one separate circuit-board section each, can be supplied with current or voltage.

The cross section furthermore shows that the enclosure as a whole is the U-shaped hollow profile 1*a*, and also a transparent potting 1*b* that completely fills the interior of hollow profile 1*a*, while at the same time covering individual circuit boards 2 and the elements mounted thereon at least on one side, preferably, on all sides.

The bottom view and side view of the LED strip according to the invention show here that the cable 6 can thus be routed longitudinally of the LED strip so as to electrically contact the contact elements 5 at spacings, here equidistant, so as to supply electrical power to the individual modules inside the LED strip according to the invention.

What is thus revealed is that a flexibility of the LED strip according to the invention is also created in a plane parallel to the circuit board surface due to the gap A between individual separate circuit boards 2, as well as in other axes, thereby producing a flexible LED strip having a plurality of bending axes despite the rigidity of the individual circuit boards 2.

Provision can obviously also be made whereby in each case flexible circuit boards are also used instead of rigid circuit boards, thereby even further enhancing the flexibility of an LED strip according to the invention.

Severability of an LED strip according to the invention is easily enabled, in particular within the entire gap A between the separate circuit boards, without degrading any electrical functionality of the modules located between the separation points in response to this severing. When a separation is made within region A, as FIG. 1 shows, the waterproof seal continues intact since no electronic/electrical components extend into the separation region.

Figures 2, 3:
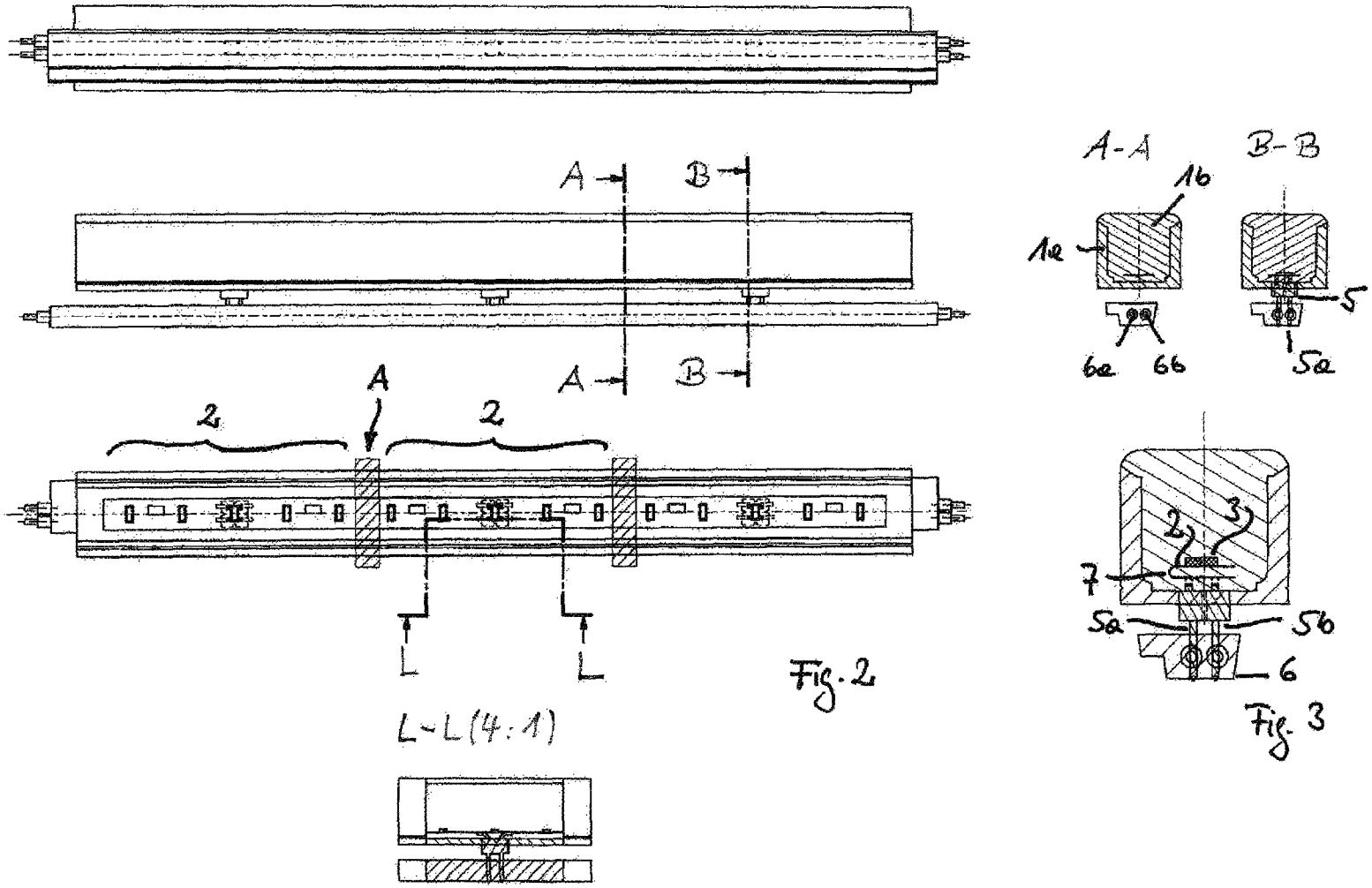
FIG. 2 shows an embodiment in which the individual modules are mounted on a shared flexible circuit board.
FIG. 3 shows a variant of a folded circuit board.

FIG. 2 provides analogous views showing an alternative embodiment in which, unlike the embodiment of FIG. 1, all of the modules and their circuit-board sections 2 comprising these modules are mounted on a single shared flexible circuit board. Although individual circuit-board sections 2 and thus the modules are thereby mechanically connected to each other in gaps A since the material of the flexible circuit board is present in the gaps, no electrical contact is provided, however, in this embodiment according to the invention between the individual modules, that is, only empty circuit board material without any electrically conductive traces or electronic components exists in the gaps.

Each circuit-board section 2, as in the embodiment of FIG. 1, also has in this embodiment a central contact element that, in contrast to FIG. 1, is however implemented in such a way that it comprises at least two pins 5*a*, of which at least one pin each is associated with a required pole of the current or voltage supply. It is accordingly also possible to route longitudinally a connector cable 6 that has two wire lines that are each contacted by a respective one of the pins of contact element 5, piercing the outer insulation of these lines and thus coming into contact with the metal conductors of the wires.

Here too, the flexible circuit board together with individual circuit-board sections 2 is mounted in the interior of the hollow profile 1*a* that is open at the top as seen in view in the figure, where a gap is clearly provided here between the circuit board and the floor of the hollow profile 1*a* in order to ensure that the potting 1*b* that completely fills the interior and fact completely surrounds the flexible circuit board. Just as in the previous embodiment, the floor of hollow profile 1*a* is provided for each contact element 5 with a respective hole through which the contact element makes the contact region of each circuit-board section accessible from the outside. Each contact element 5 can alternatively pierce the floor of hollow profile 1*a* by means of pins.

Gaps A are provided between the individual circuit-board sections, as in the previous embodiment, although the individual modules in these gaps are not, however, mounted with a gap relative to the circuit board material but instead are only mounted with a gap relative to the electrical implementation without any electrical contact, whereas they are essentially mechanically connected by the flexible circuit board material. Since this gap does not include any electrical connections, it is possible here, as in the embodiment of FIG. 1, to transversely sever the LED strip according to the invention, exposing only the flexible empty circuit board terminating in the separated end region of the LED strip.

FIG. 3 shows an alternative embodiment in which the flexible circuit board 2 or each circuit-board section 2 is folded 180° at a fold line 7 extending longitudinally such that it is possible to fit this circuit board with the electrical or electronic components only from one side, and then to fold over one part of the circuit board that has contact elements 5 by 180° along the fold line, thereby creating relative to the folded circuit board 2 an upper face on which light-emitting diodes 3 are mounted, and a lower face comprising contact elements 5. In contrast to the approach in the diagram of FIG. 3, provision can be made whereby the two folded regions of the flexible circuit board contact each other. It is also even possible to glue them together.

Just as in FIG. 1, the embodiments of FIGS. 2 and 3 have enhanced flexibility that also yields a flexibility in the plane of the circuit board surface, eliminating the conductive traces of the power supply that in the prior art are of large cross-section and mounted on the flexible circuit boards, and the power supply is implemented separately and externally relative to the enclosure.

Any twisting of a flexible circuit board as indicated in FIG. 2 or also FIG. 3 presents no problems here since the twisting in any case strains only electrical conductive traces of small cross-section, or in fact only those regions of the flexible circuit board that are completely free of conduct traces and electrical components.

Figure 4:
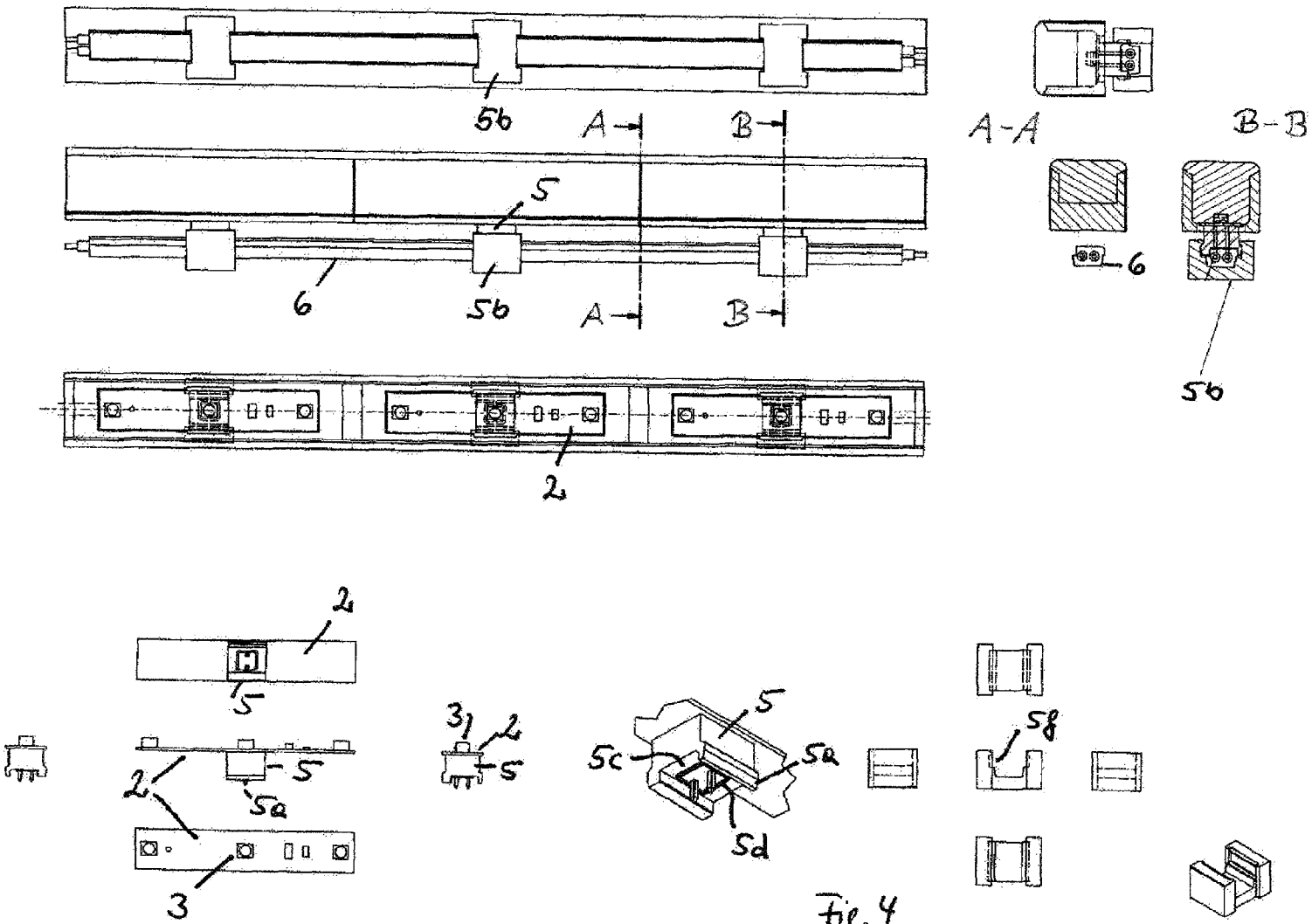
FIG. 4 shows a preferred embodiment of the contact element of FIGS. 2 and 3.

FIG. 4 shows a development of the contact element 5 in FIG. 2 or 3 that in this case also has pins 5*a* to pierce the line 6. The contact element 5 here has a groove 5*c* in whose floor pins 5*a* are mounted that project transversely from this groove floor, thereby allowing them to pierce the line 6 that is pushed into the groove 5*c* and contact the conductors therein.

The embodiment here is implemented so that a plurality of separate circuit boards 2 are provided in the LED strip and each circuit board here has a central contact region that is electrically routed out of the flexible enclosure by the contact element 5 that is mounted here on the lower face (opposite the LED). An annular seal 5*d* is furthermore located in the floor of the groove 5*c* and the seal surrounds the pins 5*a*.

To securely attach the line 6, another mating element 5*b* is provided here so the conductor inserted into the groove 5*c* is covered and locked in place on the contact element 5. To this end, the contact element has groove walls 5*e* provided as snap-in flanges that can engage undercut areas 5*f* in the groove walls of a groove in the mating element 5*b*. The contact element 5 and mating element 5*b* thus create a unit that surrounds the line 6 and secures it in place.

It is obvious that this embodiment of the contact element can be used not only in the specific embodiment shown here that has separate circuit boards 2, but can be used generally with every embodiment of the LED strip.

FIG. 5 shows an end piece 7 that functions to cover an open conductor end of the line 6, both mechanically as well as electrically, in other words for example for insulating purposes. This piece has a top part 7*an* and a bottom part 7*b* that can be connected to each other at mutually facing connecting faces 7*c*, and at least one of the parts, preferably, both have a groove 7*e* that terminates in a lateral face 7*d* of part 7*a*, 7*b* and is open toward the other part, into which groove one end of power-supply line and/or control-signal line 6 can be inserted.

The bottom parts 7*b* here has an annular seal 7*f* whose one section is located in connecting face 7*c* and whose other section is located in the groove floor and walls and annularly surrounds the end of the groove 7*e*.

The top part 7*a* has a seal 7*g* only in the groove wall and in the groove floor, in particular at a site in the groove that corresponds to that site in the groove of the other part 7*b* at which the respective annular seal 7*f* is located in the groove wall and floor. If the end piece 7 is closed by joining parts 7*an* and 7*b*, the seals 7*f* and 7*g* first of all surround the conductor and also the two connecting faces also seal this circumference.

FIG. 5 furthermore reveals that one of the parts, here the top one, has side wings 7*h* that project from connecting face 7*c* toward the other part and that engage complementary side recesses 7*i* of the other part, here the bottom part 7*b*.

Figure 6:
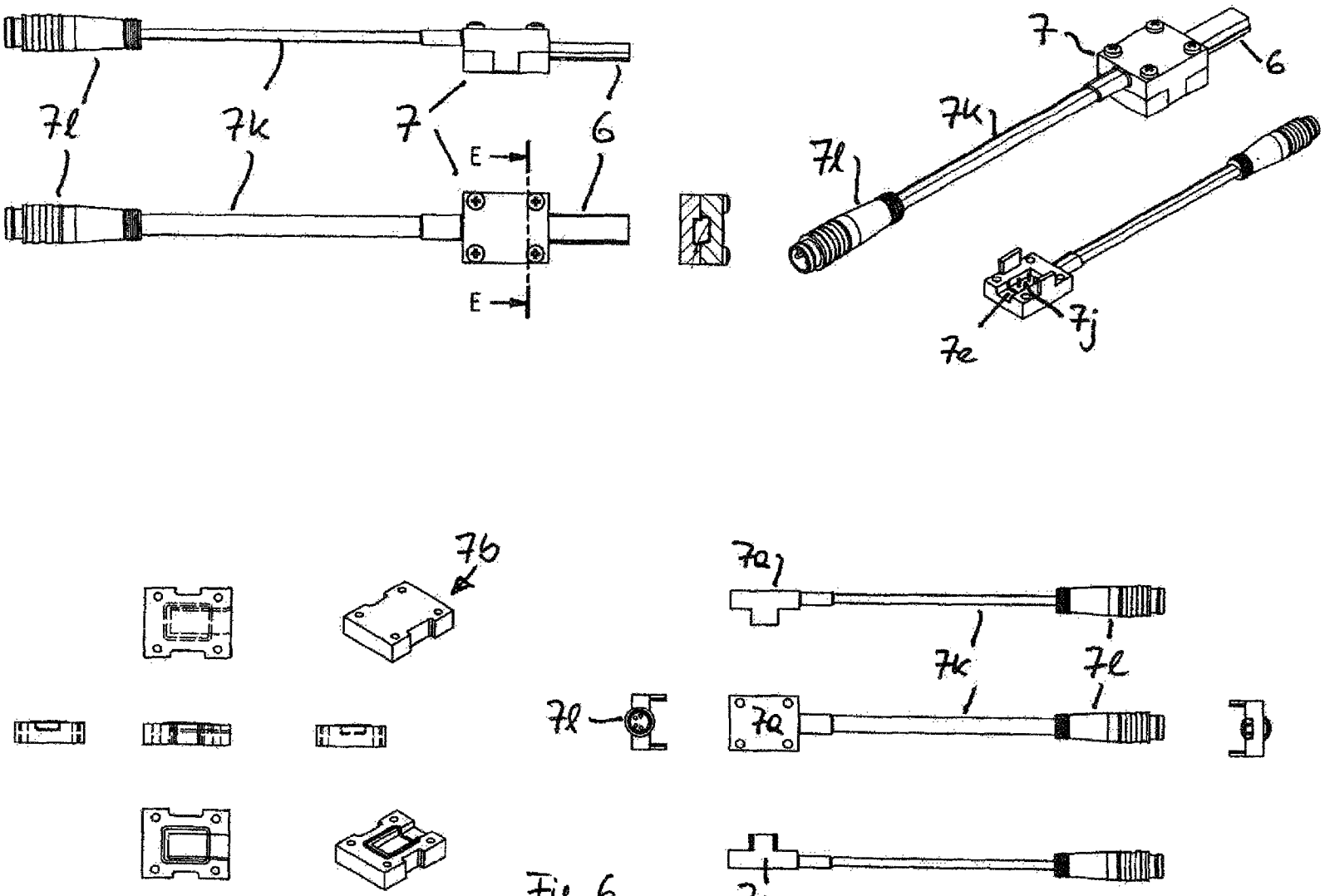
FIG. 6 is a development of the end piece of FIG. 5 for feeding in or tapping current or signals at the end of a line.

FIG. 6 shows a development of the end piece 7 of FIG. 5, in which the end piece functions as a connector at an end of the line 6. The design is identical to that of FIG. 5, and so reference is made to the relevant description there. Augmenting this is the fact that the groove floor here of groove 7 of one of the parts, top part 7*a*, has pins 7*j* projecting from the groove floor that pierce the end of the line 6 inserted in the groove and contact the conductors located therein. The pins 7*j* are electrically connected inside the part 7*a* to the conductors of a connector cable 7*k*, a plug connector 7*l* being located at the end of the conductors. The bottom part 7*b* is identical to that of FIG. 5.

Figure 7:
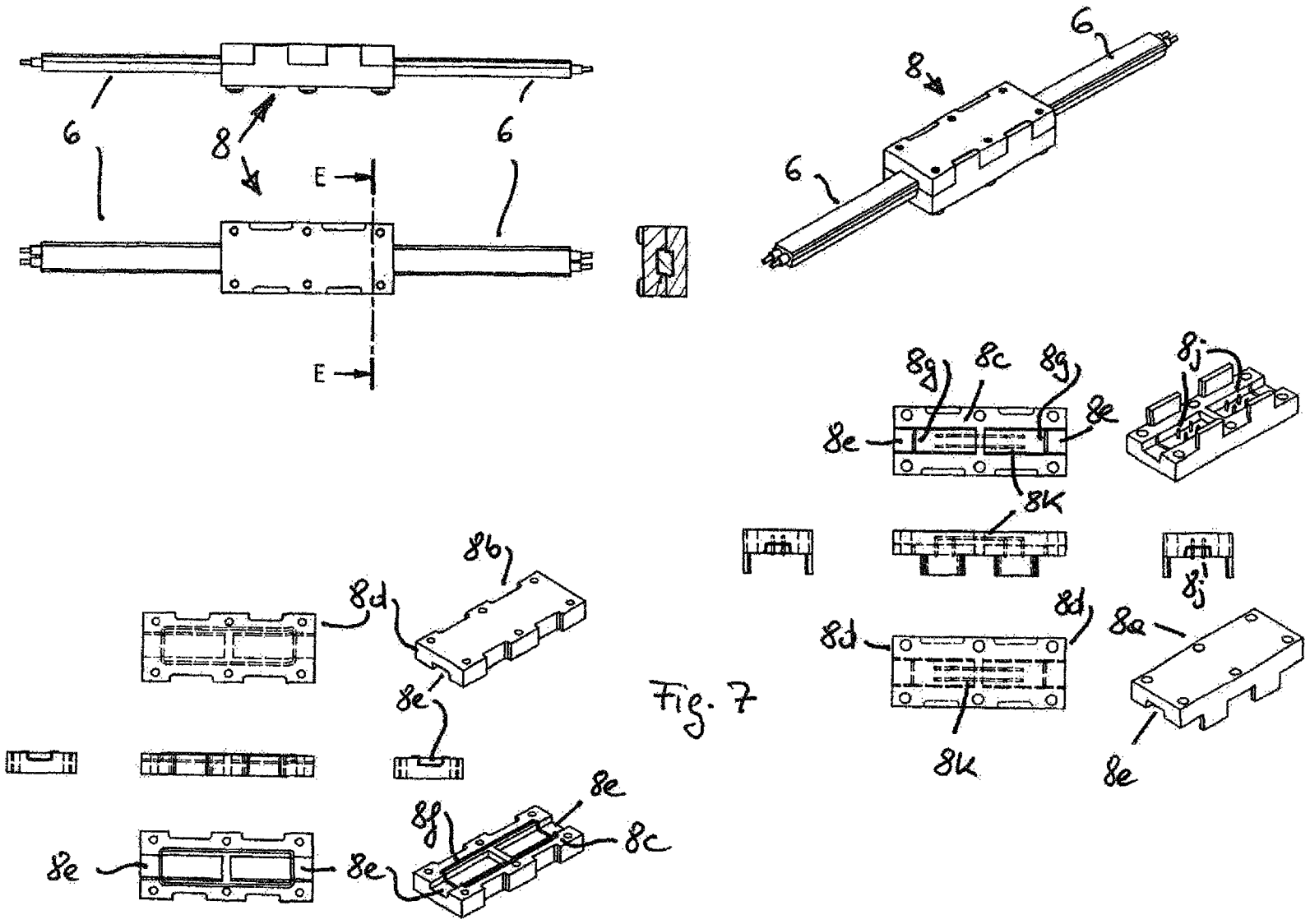
FIG. 7 is a coupling piece for the power-supply lines or control-signal lines.

FIG. 7 shows a coupling piece 8 for power-supply lines or control-signal lines 6 that enables two separate conductor pieces 6 to be electrically connected to each other at their ends. To this end, the coupling piece 8 has a top and bottom parts 8*an* and 8*b* that can be connected to each other at respective mutually facing connecting faces 8*c*, and at least one of the parts, preferably both in the connecting face, has two grooves 8*e* that extend longitudinally, are preferably separated, terminate respectively in one of two mutually opposite lateral faces 8*d* of the part, and are open toward the other part, so one end of one of two power-supply lines and/or control-signal lines can be inserted in each of grooves 8*e* and at least two contacts 8*j*, in particular at least two pins 8*j* projecting from the groove floor, are mounted in the floor of each of the grooves so as to effect electrical contact with one of the two power-supply lines and/or control-signal lines, the contacts 8*j* of both grooves 8*e* being electrically connected to each other in pairs. Electrical connections 8*k* here are routed inside the part 8*a*.

The bottom part 8*b* here has an annular seal 8*f* whose one sub-region is located in the connecting face 8*c*, and whose other sub-region is located in the groove floor and walls of both grooves 8*e*, and the seal annularly surrounds the ends of both grooves.

The top part 8*a* has a seal 8*g* in each groove that is located only in the groove wall and in the groove floor, in particular each at a site in the groove that corresponds to that site in the groove of the other part at which the annular seal is located in the groove wall and floor.

The same sealing principle is implemented here as for the seals 7*f* and 7*g* in FIG. 5, however, in both conductor ends simultaneously.

Figure 8:
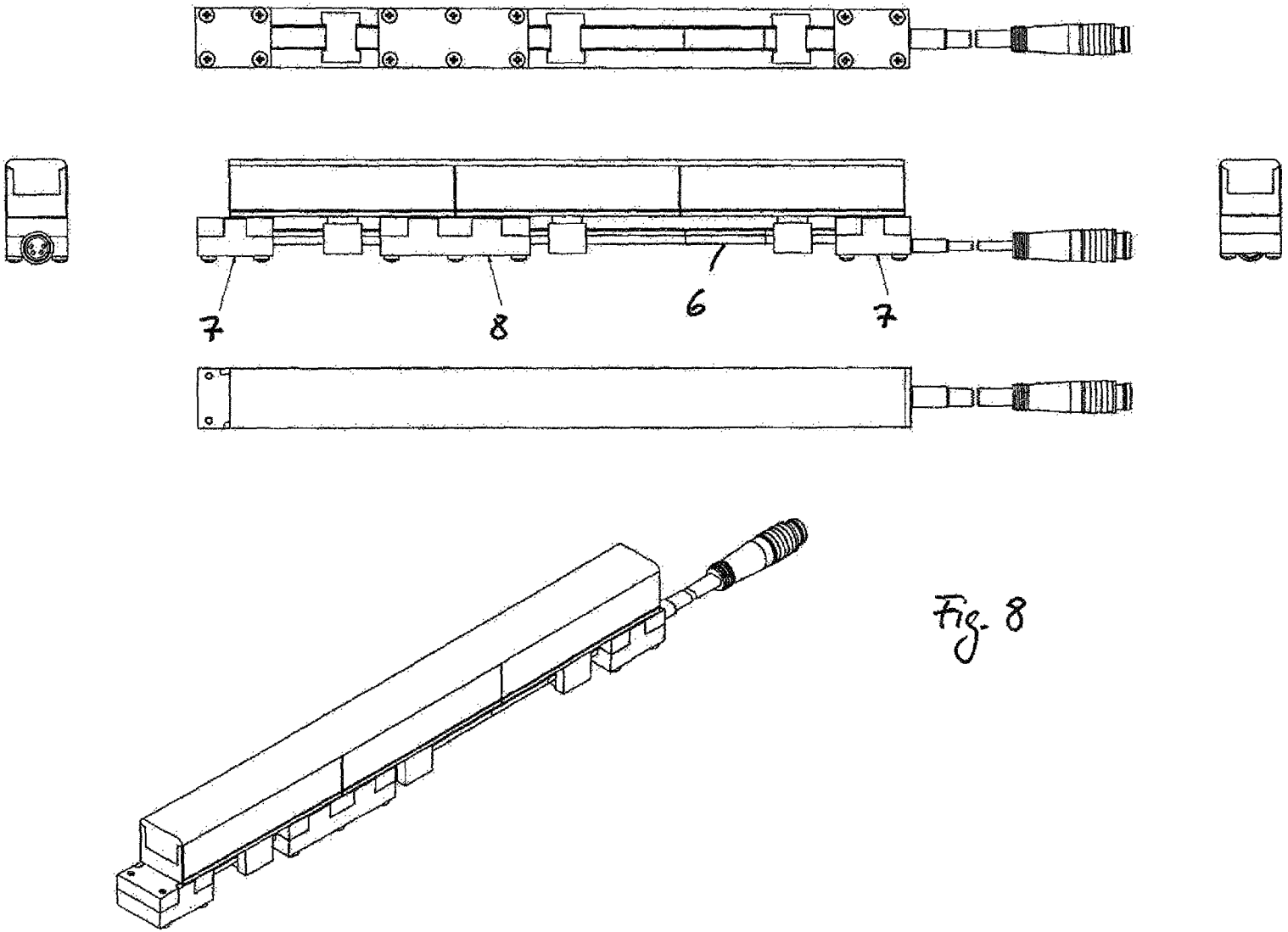
FIG. 8 shows the use of the end pieces and coupling pieces on a line of an LED strip.

FIG. 8 shows the installation of end pieces 7 with and without the power input and the coupling pieces 8 on the line 6 to supply electric power to an LED strip.

The invention claimed is:

1. A flexible LED strip, comprising modules that include light-emitting diodes arranged successively at intervals, wherein the light-emitting diodes of each module are electrically interconnected on one circuit board each together with other electronic components, the LED strip can be severed between the modules without destroying the electrical functionality of the modules, each module has at least one contact region at which a power supply can be connected to the module and all circuit-board sections are mounted in a flexible enclosure, and the at least one contact region of each module extends through the enclosure and can be electrically contacted outside the enclosure.

2. The LED strip according to claim 1, wherein a contact element attached to each circuit-board section of the module at the at least one contact region of each module extends from the circuit-board section completely through the enclosure to the outside perpendicular to the surface of the respective section to the outside to the side opposite a light emission direction to the lower face of the LED strip.

3. The LED strip according to claim 2, wherein each contact element comprises:

a) at least two pins onto which a mating element comprising at least two socket-like elements can be pushed or by which the insulating cable jacket of at least one power-supply line or control-signal line can be pierced, or b) at least two stab contacts, into which a two-strand power-supply line or control-signal line can be pushed, thereby cutting through the insulation of the line and contacting the inner conductor of the conductor.

4. The LED strip according to claim 3, wherein each contact element having at least two pins has an open groove that runs longitudinally of the LED strip, into which a power-supply line or control-signal line can be inserted, the pins being mounted in the groove projecting transversely from the groove floor.

5. The LED strip according to claim 4, wherein a mating element can be attached to the contact element so that a power-supply line or control-signal line inserted in the groove is completely surrounded by the contact element and mating element all around the line.

6. The LED strip according to claim 5, wherein walls of the groove of the contact element are snap-in flanges that interact with undercut areas in walls of a groove in the mating element so as to lock in place, or the walls of the groove in the mating element can be snap-in flanges that interact with undercut areas in the groove of the contact element so as to lock in place.

7. The LED strip according to claim 3, wherein the pins in the groove floor of the contact element are annularly surrounded by a seal that seals off from the environment a region of an insulating jacket of the power-supply line or control-signal line that is to be pierced when the line is inserted.

8. The LED strip according to claim 1, wherein each circuit-board section on which a module is mounted is a separate rigid circuit board.

9. The LED strip according to claim 1, wherein each circuit-board section on which a module is mounted is a subsection of a flexible circuit board on which a plurality of modules are mounted, no elements electrically connecting the sections being mounted on the flexible circuit board.

10. The LED strip according to claim 1, wherein the enclosure is composed of a flexible U-section profile that is open on the light-emitting side and in which the modules are mounted and that has holes in its floor through which the respective contact elements attached to the contact regions of the modules are routed from the interior of the hollow profile to the outside, the interior of the hollow profile being completely filled with a transparent potting.

11. The LED strip according to claim 1, wherein the light-emitting diodes and electronic components of each module are mounted on the same face of a flexible circuit board together with the contact elements attached to the contact regions with the contact elements in one half and the LEDs in another half of the circuit board that is divided in half in the longitudinal direction, and the flexible circuit board is folded over by 180° along a fold line that extends longitudinally of the LED strip at the center of the flexible circuit board, with the result that the LEDs and the contact elements are located on opposite sides of the folded circuit board.

12. The LED strip according to claim 1, further comprising:

a plurality of equidistant markings on the outside of the enclosure that indicate the location of a site at which the LED strip can be severed without destroying the functionality of the modules.

13. An end piece for a power-supply line or control-signal line of an LED strip according to claim 1, wherein the end piece has a top part and a bottom part that can be connected to each other at respective mutually facing connecting faces, and both parts include a groove that terminates in a lateral face of the part and is open toward the other part, into which grooves an end of a power-supply line or control-signal line can be inserted.

14. The end piece according to claim 13, wherein at least one of the parts has an annular seal whose one sub-region is located in the connecting face and whose other sub-region is located in the groove floor and the groove walls, and surrounds the end of the groove in frame-like fashion.

15. The end piece according to claim 14, wherein the other part has a seal that is located only in the groove wall and in the groove floor at a site in the groove that corresponds to that site in the groove of the other part at which the annular seal is located in the groove wall and floor.

16. The end piece according to claim 14, wherein one of the parts has electrical pin contacts mounted in the groove that project transversely from the groove floor in order to establish electrical contact with a power-supply line or control-signal line, wherein the electrical contacts are connected to a plug connector that is attached to this part.

17. A coupling piece for power-supply lines or control-signal lines of an LED strip according to claim 1, the coupling piece having a top part and a bottom part both of which can be connected to each other at respective mutually facing connecting faces, and at least one of the parts includes in the connecting face two grooves that extend longitudinally and are separated, which grooves respectively terminate in one of two mutually opposing lateral faces of the part and are open toward the other part, wherein one end of one of two power-supply lines or control-signal lines can be inserted into each of the grooves, and at least two contact pins projecting transversely from the groove floor are mounted in the groove floor of each of the grooves in order to establish electrical contact between one of the two power supply or control-signal lines, the contact pins of both grooves being electrically connected in pairs.

18. The coupling piece according to claim 17, wherein at least one of the parts has an annular seal whose one sub-region is located in the connecting face and whose other sub-region is located in the groove floor and the groove walls of both grooves and annularly surrounds the ends of both grooves.

19. The coupling piece according to claim 18, wherein the other part has in each groove a seal that is located only in the groove wall and in the groove floor, each at a site in the groove that corresponds to that site in the groove of the other part at which the annular seal is located in the groove wall and floor.

20. A connector piece for power-supply lines or control-signal lines of an LED strip according to claim 1, wherein it has a top part and a bottom part that can be connected to each other at respective mutually facing connecting faces and at least one of the parts has a continuous groove in the respective connecting face that terminates in two mutually opposing lateral faces of the part and is open toward the other part, a power-supply line or control-signal line being insertable into the groove to pass through the connector piece, and at least two contact two pins projecting transversely from the groove floor are mounted in the groove in order to establish electrical contact with an inserted power-supply line or control-signal line, the electrical contact pins being electrically connected to a connector cable that is attached to the plug connector of the connector cable.

21. The connector piece according to claim 20, wherein the electrical contact pins in the groove floor of the contact element are annularly surrounded by a seal seals off from the environment a region to be pierced of an insulating jacket of the power-supply line or control-signal line when such a line is inserted.

* * * * *